US006734350B2

(12) United States Patent
Sleishman

(10) Patent No.: US 6,734,350 B2
(45) Date of Patent: May 11, 2004

(54) TWIN PEDAL ASSEMBLY FOR A BASS DRUM

(76) Inventor: Donald E. Sleishman, Unit 11, 127-129 Newbridge Road, Chipping Norton, NSW 2170 (AU)

( * ) Notice: Subject to any disclaimer, the term of this patent is extended or adjusted under 35 U.S.C. 154(b) by 5 days.

(21) Appl. No.: 10/159,400

(22) Filed: May 30, 2002

(65) Prior Publication Data

US 2003/0000367 A1 Jan. 2, 2003

(30) Foreign Application Priority Data

May 30, 2001 (AU) ..... PR5344

(51) Int. Cl.[7] ..... G10D 13/02
(52) U.S. Cl. ..... 84/422.1; 84/422.2
(58) Field of Search ..... 84/422.1, 422.2, 84/422.3

(56) References Cited

U.S. PATENT DOCUMENTS 3,750,517 A * 8/1973 Sleishman ..... 84/422.1
5,293,000 A * 3/1994 Adinolfi ..... 84/730
5,427,010 A * 6/1995 Hoshino ..... 84/422.1

* cited by examiner

*Primary Examiner*—Kimberly Lockett
(74) *Attorney, Agent, or Firm*—Marshall, Gerstein & Borun LLP

(57) ABSTRACT

A twin pedal assembly (1) for a bass drum (2), said pedal assembly including a base (3) adapted for connection to the drum. The base includes a pair of posts (11), each post being adapted to support a respective beater shaft (15). Each beater shaft is in turn adapted to support a corresponding beater (16), incorporating an elongate stem (17) extending outwardly from the beater shaft and a head (18) supported on the remote end of the stem. The head is adapted for contact with a strike zone (19) on the diaphragm or skin (2) of the drum.

30 Claims, 9 Drawing Sheets

TWIN PEDAL ASSEMBLY FOR A BASS DRUM

FIELD OF THE INVENTION

The present invention relates generally to drums, and more particularly to a foot operated pedal device of the type used to play floor standing bass drums.

BACKGROUND OF THE INVENTION

DISCUSSION OF PRIOR ART

In most contemporary musical styles ranging from classical through to jazz, pop and rock, bass drums are typically played using a foot operated pedal arrangement. A typical arrangement of this type includes a base or frame designed to rest on the flood and adapted for connection to the drum, so as to maintain the pedal and the drum in predetermined spatial relationship. The base is adapted to support a beater shaft for rotation about an horizontal axis. The beater shaft supports an elongate beater stem and a beater head is attached to the remote end of the stem. Some form of drive mechanism extends between the foot pedal and the beater shaft, such that depression of the foot pedal by the player effects rotation of the beater shaft. This in turn drives the beater head forward in an arc defined by the beater stem, so as to hit the diaphragm or skin of the drum. This arrangement leaves the drummer's hands free to play other drums and symbols in the set or "kit".

Early arrangements of this type only made use of a single pedal activating a single beater. This limited the speed and complexity of rhythms that could be played on the drum, while leaving the player's other foot underutilised. As a result of these limitations, so-called "twin pedal" arrangements were developed, whereby both of the player's feet could be used to operate two pedals, and hence two beaters, independently.

While these twin pedal arrangements allowed more complex bass drum rhythms to be played more easily, they have hitherto been subject to a number of inherent limitations. The first of these arises because the ideal strike zone or "sweet spot" on the drum skin is relatively small and striking the skin outside of this zone produces an inferior quality of sound. Most twin pedal devices require the beaters to be positioned apart from one another, to the extent that with the assembly centrally positioned, the beaters make contact with the drum skin on either side of the optimum strike zone, rather than hitting it directly.

In an attempt to address this problem, some twin pedal assemblies have positioned the beaters as closely together as possible. In many cases, however, this has necessitated spacing the foot pedals similarly closely together, which severely compromises the ergonomics from the player's perspective.

Other known twin pedal arrangements have attempted to address this difficulty, using relatively complex drive mechanisms, extended linkages and interconnecting universal joints, so as to space the pedals outwardly from the beaters. A limitation with arrangements of this type, however, is that these more complex linkage arrangements introduce flexibility and friction into the drive mechanism, both of which absorb power, reduce efficiency and compromise the sensitivity and "feel" of the system as experienced by the player. A common complaint from players in this context is that such systems feel "remote" or "disconnected". This problem is further exacerbated as the joints, links and other connections are progressively subject to wear, and thereby introduce free play or "slack" into the system. Systems of this type are also susceptible to rapid wear and failure due to the relatively high stresses imposed on the key linkages and supporting frame elements.

A further limitation with arrangements of this type is that it is ideally desirable to position a snare drum stand centrally in front of the bass drum, and hence between the bass drum pedals. Most known arrangements have either not been able to accommodate a central snare drum stand in this way, or have accommodated a snare stand by positioning the beaters sufficiently far apart to compromise sound quality. Others have relied on complex linkage arrangements with reduced sensitivity and feel as noted above, or have relied upon some combination of these compromises.

In an attempt to address some of these issues, it has also been known to provide a twin pedal arrangement with more complex geometry in which the axes of the beater shafts lie in an horizontal plane, but are not colinear. Rather, the axes are oriented obliquely, such that the beaters converge as they move toward the drum skin and diverge as they move away. While this arrangement addressed some of the more significant limitations of previously known systems to a degree, a major problem is that because of the oblique orientation of the beater shafts, the beaters themselves strike the drum skin at an oblique angle, rather than substantially perpendicularly or "square on". It has been found that this compromises playing power, as well as the tonal qualities of the resultant sound.

It is an object of the present invention to overcome or substantially ameliorate one or more of these disadvantages of the prior art, or at least to provide a useful alternative.

SUMMARY OF THE INVENTION

Accordingly, the invention provides a twin pedal assembly for a bass drum, said pedal assembly including a base adapted for connection to the drum, a pair of independent beater shafts supported by the base and connected respectively to a corresponding pair of beaters, each beater comprising a elongate stem extending outwardly from the associated shaft and a head supported on the remote end of the stem, the assembly further including a pair of independently operable foot pedals pivotably mounted to the base, and drive means connecting the foot pedals to the respective beaters such that depression of each pedal in use drives the associated beater into contact with a strike zone on a skin on the drum, the beater shafts being supported for rotation about vertically inclined axes whereby the loci of movement of the beaters converge toward the strike zone, and intersect respectively with the skin in a generally perpendicular orientation.

Preferably, the frame incorporates a pair of generally upright posts, adapted respectively to support the beater shafts at symmetrical angles declining toward each other via journal bearings. Preferably, the angle of inclination of each beater shaft is between 5 and 45 degrees, and ideally around 20 degrees to the horizontal.

Preferably also, the support posts are disposed and the beater shafts are inclined in predetermined relationship with one another, such that the points of contact between the beaters at the drum skin are less than 12 centimeters apart, and ideally no more than 6 centimeters apart, thereby ensuring that both beaters are able to hit a relatively narrow strike zone simultaneously.

Preferably, the drive mechanism includes a drive plate associated with each foot plate, a drive cam connected to each beater shaft, and a flexible drive linkage extending between each drive plate and the corresponding drive cam. Most preferably, the drive linkage takes the form of a chain but may alternatively comprise a flexible cord, strap, cable, line or other suitable form of pliable linkage. As a further alternative, one or more rigid linkages with suitable flexible connections or universal joints may be used.

Preferably, the assembly includes a spring idler connected with each beater shaft, and a spring extending effectively between the base and the idler, so as to bias the beaters resiliently toward a rest position in which the stems are disposed in a generally horizontal orientation and the heads are positioned away from the drum.

Preferably, the drive cams are configured such that for a constant rate of travel of the foot pedals, maximum torque and hence acceleration are transferred to the beaters during the initial phase of movement away from the rest position, and maximum rotational speed and hence momentum are imparted during the final phase of movement of the beaters toward the strike zone.

Preferably, each beater is mounted to the corresponding beater shaft by means of an offset bracket, such that each stem and the associated drive cam are radially displaced from the rotational axis of the beater shaft. Most preferably, the offset bracket is disposed such that with the beater stem in the generally vertical orientation and the beater head contacting the strike zone, the stem and the drive cam are displaced forwardly of the beater shaft, closely adjacent the drum skin.

Preferably, each beater and the associated drive cam are mounted on the outer end of, and on the same side of, the respective beater shaft so as to maintain substantially direct and approximately coplanar of transmission of drive between each foot pedal drive plate and the associated beater.

Preferably, adjustment mechanisms are provided between each foot pedal and the associated drive plate, between each drive plate and the associated drive cam, between each drive cam and the associated beater shaft, between each spring and the associated idler plate, between each idler plate and the associated beater shaft, between each offset bracket and the associated beater shaft, and between each stem and the associated offset bracket. Advantageously, these mechanisms facilitate adjustment of the various operational characteristics of the pedal assembly to suit the anatomical ergonomics, playing techniques, desired sound qualities, surrounding acoustics, musical styles and personal preferences of the player.

Preferably, the base is formed in two halves to facilitate compact storage and transportation. Alternatively, however, the base may be formed as a single structure, or from more than two components in an assembly.

BRIEF DESCRIPTION OF THE DRAWINGS

A preferred embodiment of the invention will now be described, by way of example only, with reference to the accompanying drawings in which.

DETAILED DESCRIPTION OF PRFERRED EMBODIMENTS

Figure 6:
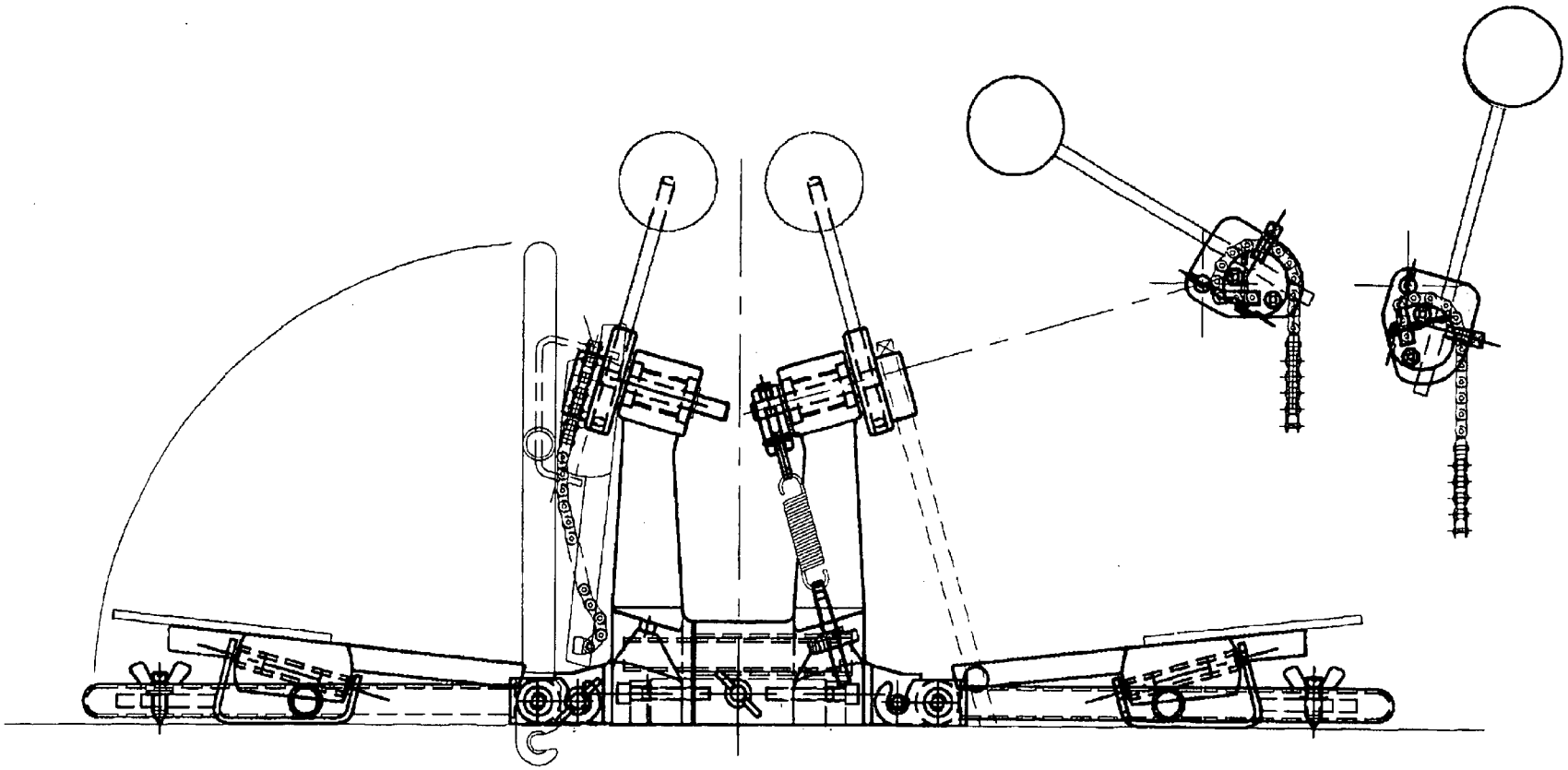
FIG. 6 is a more detailed general assembly of the pedal assembly in front elevation, with some items omitted for clarity.
Figure 7:
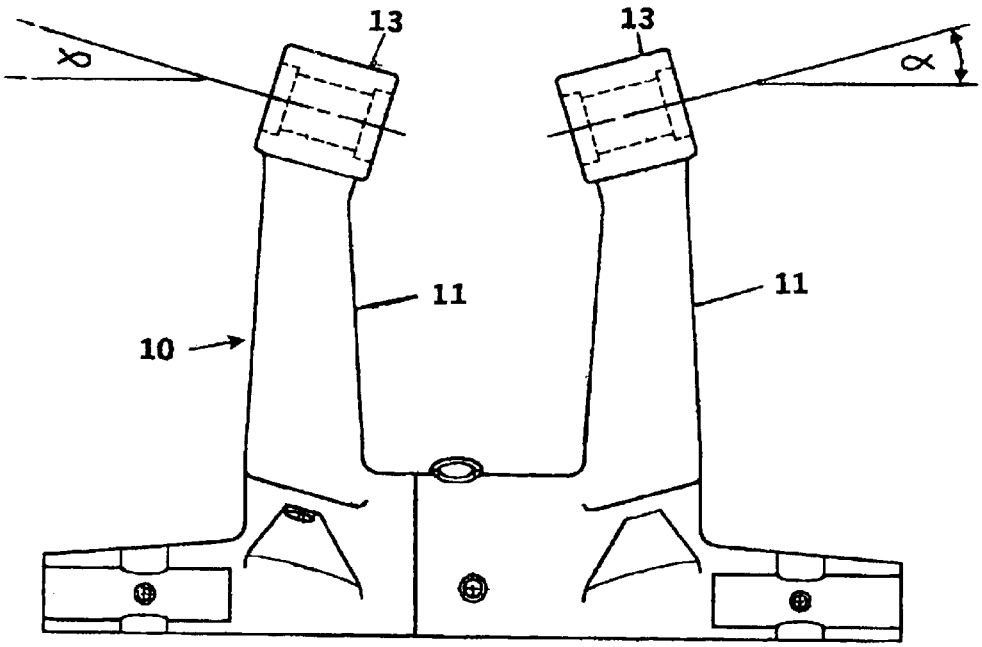
FIG. 7 is a front view of a sub-assembly of a main frame forming part of the base incorporating the beater support posts.
Figure 8:
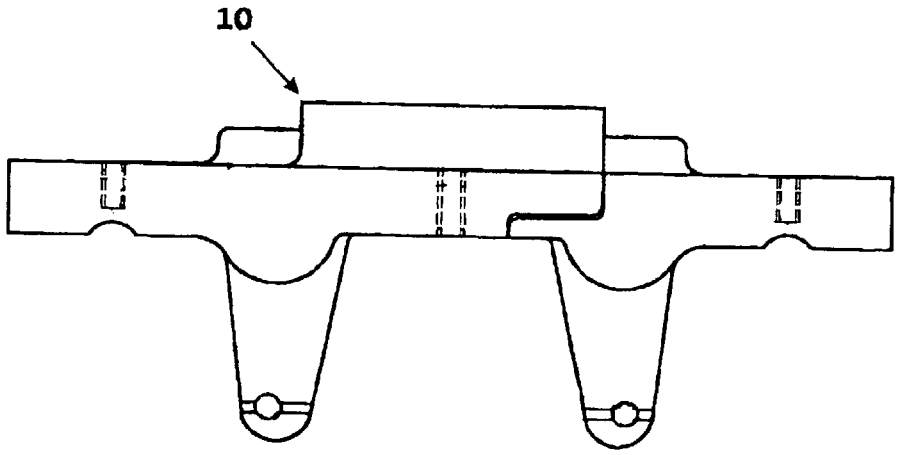
FIG. 8 is an underside view of the sub assembly of FIG. 7.

Referring to the drawings, wherein like features are denoted by corresponding reference numerals, the invention provides a twin pedal assembly 1 for a bass drum 2. The assembly comprises a base 3 adapted for connection to the drum by means of a bass drum clamp (not shown). The base comprises a main frame in the form of a two-part sub-assembly (10), each component of which incorporates a respective beater support post 11, as best seen in FIG. 7. The main frame 10 when assembled is adapted for connection to a base frame 12, which also forms part of the base 3 and similarly takes the form of a two-part sub-assembly comprising left and right half sections. Pivotal linkages enable the left and right sections of the base frame to fold upwardly into close vertical alignment with the respective support posts of the main frame to facilitate compact transportation and storage, as best seen in FIG. 6.

Each post 11 on the main frame 10 incorporates a journal bearing assembly 13 adapted to a support a respective beater shaft 15. Each beater shaft is in turn adapted to support a corresponding beater 16, incorporating an elongate stem 17 extending outwardly from the beater shaft and a head 18 supported on the remote end of the stem. The head is adapted for contact with the strike zone 19 on the diaphragm or skin 20 of the drum.

The beater shafts are supported for rotation about corresponding axes $\alpha$ (see FIG. 7), inclined symmetrically toward one another at between 5 and around 45 degrees, and ideally at around 20 degrees to the horizontal. Although inclined to the horizontal, the rotational axes of the beater shafts lie in the same vertical plane. In this way, the beater shafts are laterally spaced apart and inclined in predetermined relationship with one another such that the loci of movement of the beaters diverge away from the strike zone, and yet respectively intersect perpendicularly with the drum skin such that the beaters strike the skin square on. In other embodiments, it will be appreciated that the beater shafts may be inclined relative to one another in a horizontal, as well as a vertical plane. The points of contact between the beaters and the skin are preferably less than 12 centimeters apart, and ideally no more than around 6 centimeters apart, to ensure that both beaters are able simultaneously to hit the strike zone or acoustic "sweet spot" 19 of the skin, which is typically a centrally located circular region of only around 10 centimeters in diameter.

The assembly further includes a pair of independently operable foot pedals 25 and a drive mechanism 26 connecting each foot pedal to the associated beater shaft. The drive mechanism includes a drive plate 27 pivotably mounted to a corresponding side of the base frame 12, a drive cam 28 connected to the respective beater shaft, and a flexible drive linkage 29 extending between each drive plate and the associated drive cam. The flexible linkage preferably takes the form of a chain, incorporating a universal link with orthogonal pivots to enable the base frame sections to fold up toward the main frame without disconnecting the drive mechanism. It will be appreciated, however, that the drive linkage may alternatively comprise a flexible cord, strap, cable, belt, line or other suitable form of pliable linkage. The foot pedals are laterally adjustable with respect to their associated drive plates, to enable the spacing between the pedals to be adjusted to suit the player's size, technique and ergonomic preferences.

Figure 4:
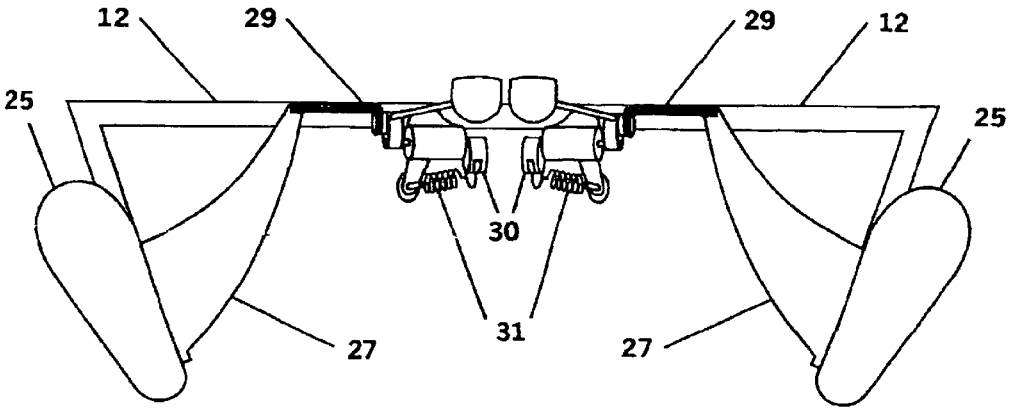
FIG. 4 is a plan view of the pedal assembly, showing the beaters in the striking position.
Figure 5:
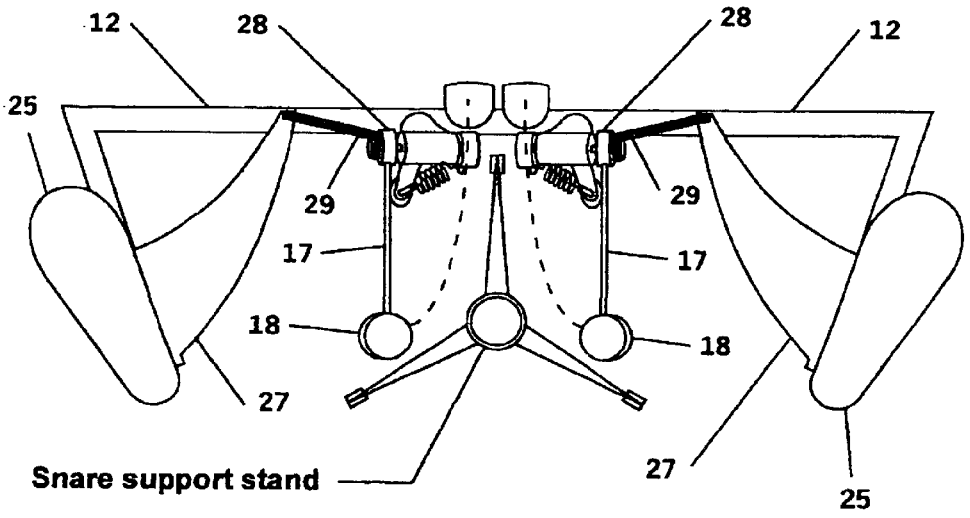
FIG. 5 is a plan view similar to FIG. 4, showing the beaters in both the striking position and the rest position, and the arcuate loci of movement between them around an intermediate snare drum stand.
Figure 10:
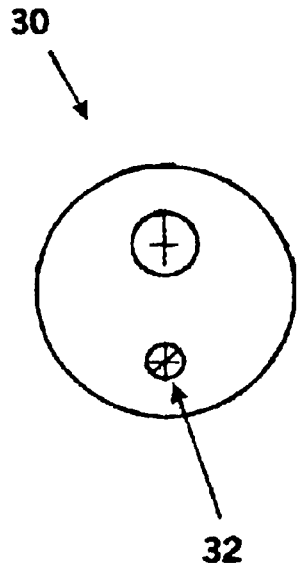
FIG. 10 is a front view of the spring idler.

The assembly further includes a spring idler 30 connected with each beater shaft and a spring 31 extending effectively between the base and the idler. This mechanism biases the beaters resiliently toward a rest position, as shown in FIG. 5, wherein the stems 17 are disposed in a generally horizontal orientation and the beater heads 18 are positioned away from the drum. The idler incorporates a crank pin 32 to which the spring is anchored (see FIG. 10), with the rotational position of the crank pin relative to the beater shaft being selectively adjustable by means of a grub screw or other suitable mechanism (not shown) to provide selectively variable "rising rate" spring characteristics. More particularly by virtue of this arrangement, the restoring force of the spring, against which the player's foot works, is at a minimum with the beaters in the rest position from which they must accelerate, and at a maximum with the beaters in contact with the strike zone, at which point the velocity and momentum of the beaters are also typically at their maximum values (see FIGS. 4 and 5). The initial preload in each spring is also variable by means of an associated adjustment screw 33.

Figure 3:
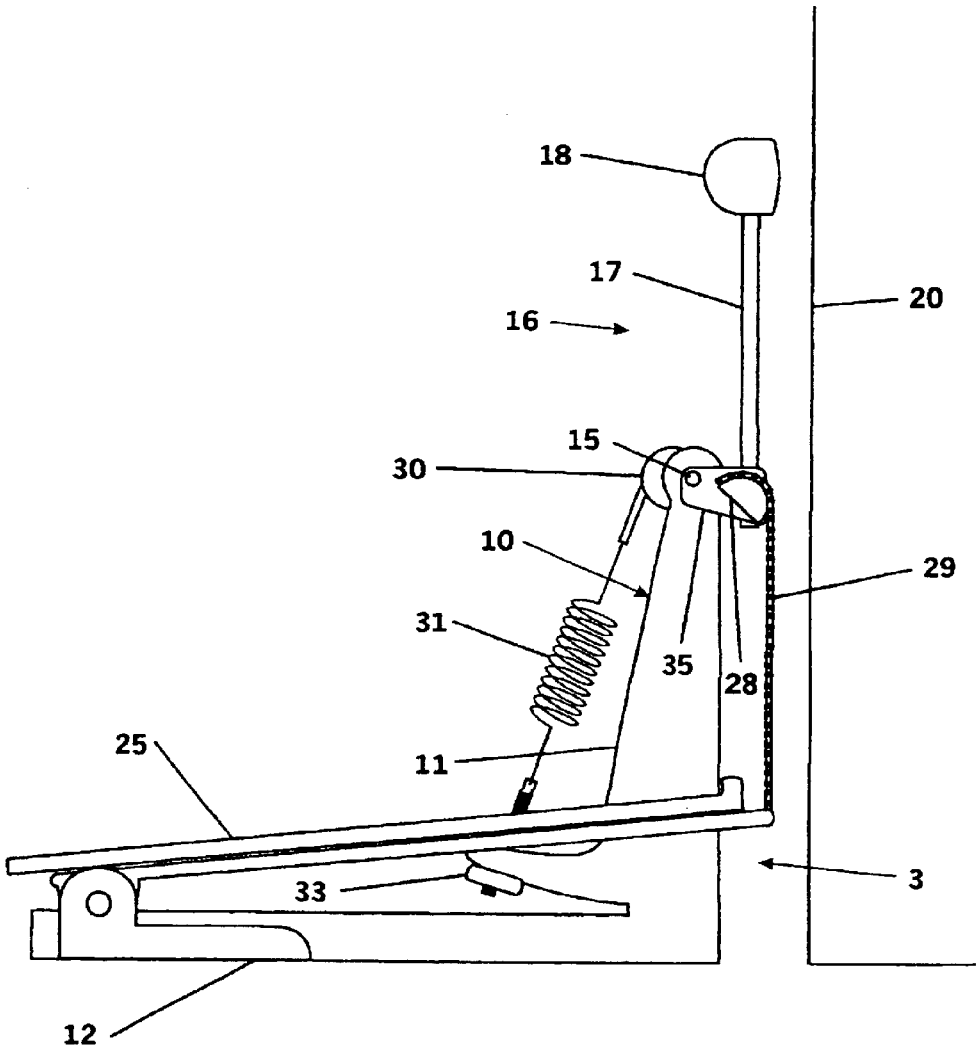
FIG. 3 is a side elevation of the pedal assembly.
Figure 9:
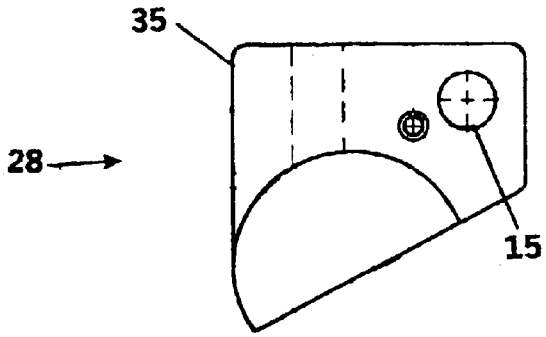
FIG. 9 is a front view of the drive cam for the left-hand beater shaft.

Each drive cam 28 is configured such that for a constant rate of travel of the foot pedal, maximum torque and hence acceleration are transferred to the beater during the initial phase of movement away from the rest position, whereas maximum rotational speed is transferred during the final phase of movement of the beater toward the strike zone. As best seen in FIGS. 3 and 9, the beater is mounted to the beater shaft by means of an offset bracket 35, such that each beater stem and the associated drive cam 28 are radially spaced apart from the axis of the beater shaft 15. The position of each offset bracket is adjustable with respect to the beater shaft. Typically, however, the offset bracket is positioned such that with the beater stem in the vertical orientation and the beater head in contact with the strike zone (as shown in FIG. 3), the stem and the drive cam are displaced forwardly of the beater shaft. This provides the optimum mechanical advantage for the drive mechanism, and the optimum square on angle of attack for the beater head, at the point of contact with the strike zone.

Figure 1:
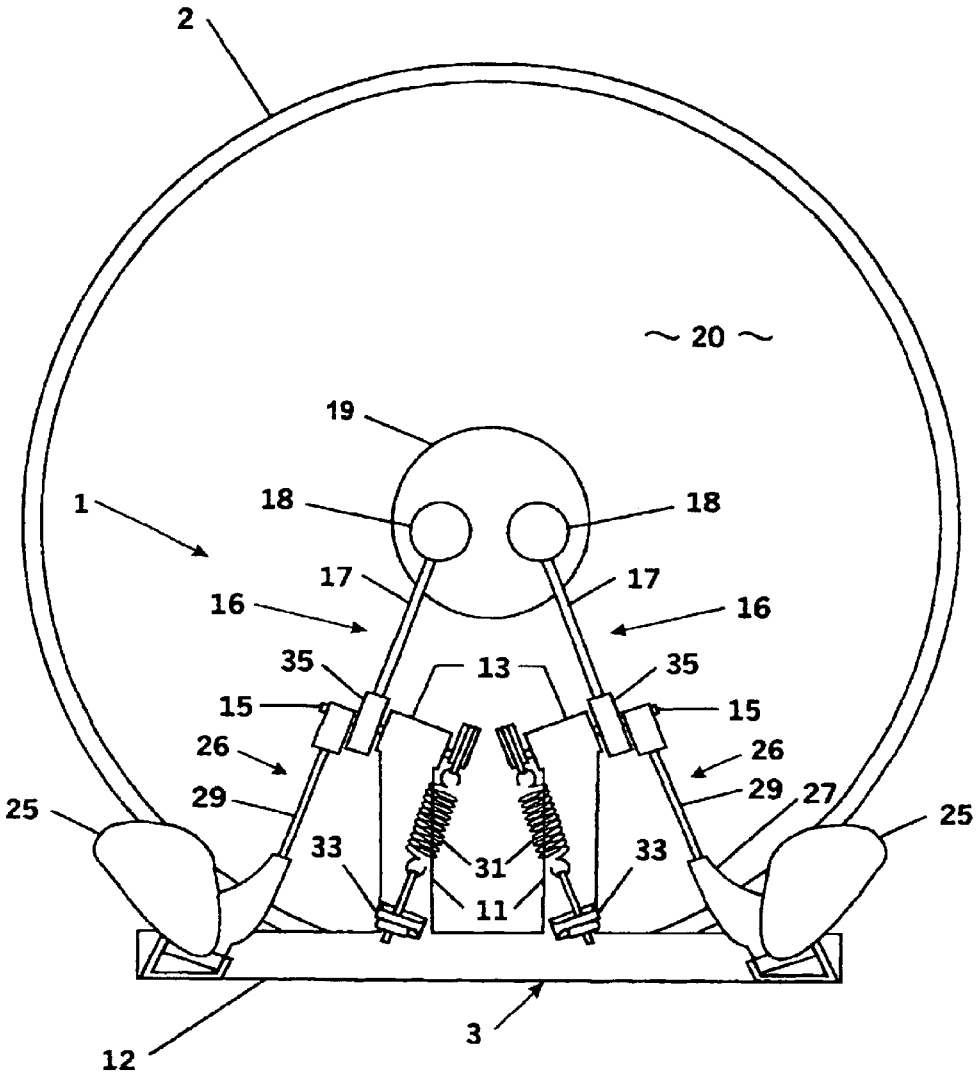
FIG. 1 is a front elevation showing a twin pedal assembly for a bass drum, according to the invention.
Figure 2:
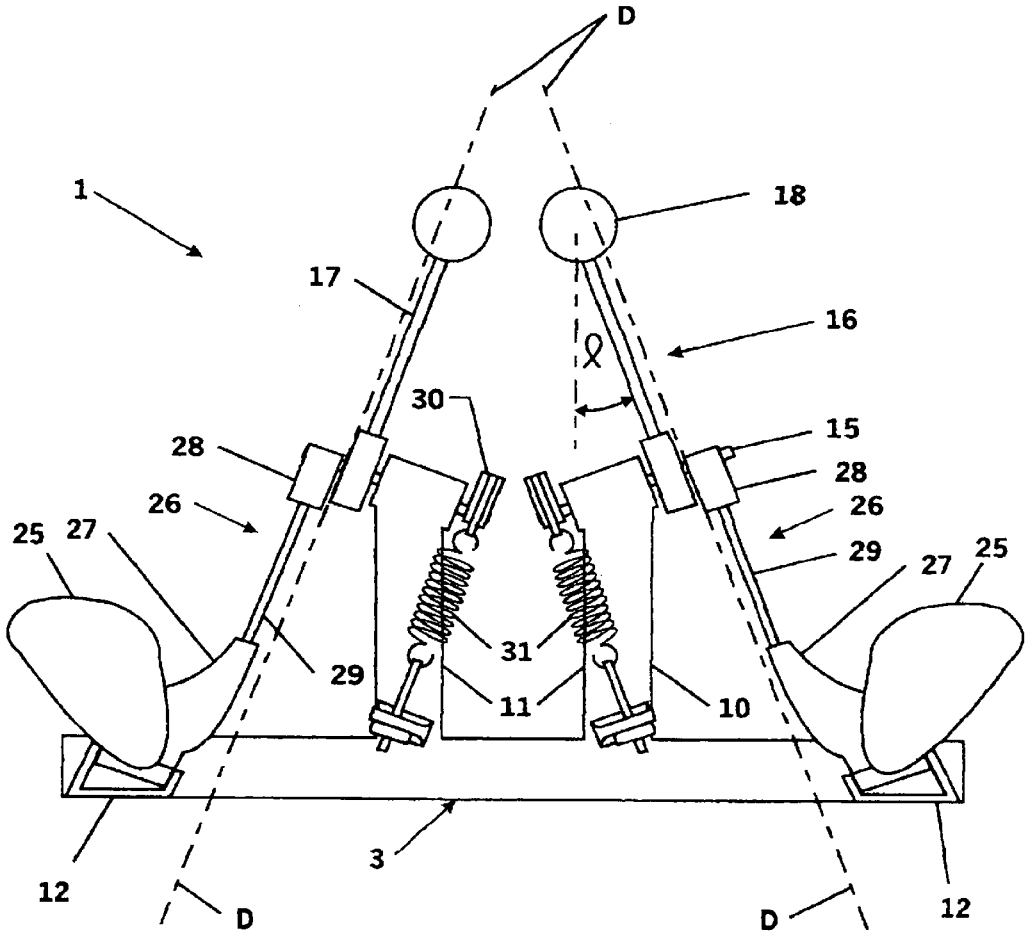
FIG. 2 is a rear elevation showing the pedal assembly of FIG. 1.

It will be apparent from FIGS. 1 and 2 that each beater and the associated drive cam are mounted on the outer end of, and on the same side of, the corresponding beater shaft, with all of the major rotational axes between the various linkages in the system being substantially parallel to one another. This has been found to be a significant advantage or the invention, as it maintains a substantially direct and approximately coplanar transmission of drive between each drive plate, and the associated beater as indicated by line D in FIG. 2. This line represents an end view of the respective drive plane, which it will be appreciated is also normal to the plane of the drum skin. This direct line of drive minimizes the twisting force couples, and consequentially the distortions under load and the dynamic frictional losses within the system, while creating a discernible perception of enhanced sensitivity, lightness, directness and "feel" for the player, as well as providing superior acoustic characteristics.

In most respects, the assembly is adjustable for different player preferences and styles. In particular, a pedal adjustment mechanism 40 is provided between each foot pedal and the associated drive plate to permit adjustment of the angular orientation and lateral spacing of the pedals without altering the orientation of, or compromising the performance of, the direct drive transmission mechanism. This adjustment mechanism essentially comprises a series of locating spigots (not shown) extending downwardly from the foot pedals, and disposed for captive sliding engagement within complementary slots formed in the adjacent drive plates, in conjunction with locking screws (also not shown) to retain the respective pedals in the selected orientations. Along with the various other adjustment mechanisms previously described, this facilitates customisation of the numerous operational characteristics of the pedal assembly, to suit the anatomical ergonomics, playing techniques, desired sound qualities, surrounding acoustics, musical styles and personal preferences of the player.

The invention thus provides a twin pedal mechanism for a bass drum that allows both beaters to hit a narrow strike zone within a small radius of the centre of the drum skin and within close proximity of one another, for improved acoustic quality. At the same time, the geometric configuration of the beater shafts ensures that the beaters diverge away from the drum toward the rest position, thereby enabling a snare drum stand to be centrally positioned between the beaters and the pedals so that the ergonomics of the snare drum are not compromised. Further, the unique geometry of the system at the same time allows the beaters to strike the drum perpendicularly or squarely rather than obliquely, for optimum power, efficiency and sound quality. In addition, the direct drive transmission mechanism between the pedals and the beaters enhances the power, efficiency, sensitivity and feel of the system for the player. In all these respects, the invention represents both a practical and commercially significant improvement over the prior part.

Although the invention has been described with reference to specific examples, it will be appreciated by those skills in the art that the invention may be embodied in many other forms.

I claim:

1. A twin pedal assembly for a bass drum, comprising a base adapted for connection to the drum, a pair of independent beater shafts supported by the base and connected respectively to a corresponding pair of beaters, each beater comprising an elongate stem extending outwardly from the associated shaft and a head supported on the remote end of the stem, a pair of independently operable foot pedals pivotably mounted to the base, and drive means connecting the foot pedals to the respective beaters such that depression of each pedal in use drives the associated beater into contact with a strike zone on a skin on the drum, the beater shafts being supported for rotation about vertically inclined axes whereby the loci of movement of the beaters converge toward the strike zone, and intersect respectively with the skin in a generally perpendicular orientation.

2. A twin pedal assembly according to claim 1 wherein the base incorporates a pair of generally upright posts, adapted respectively to support the beater shafts at symmetrical angles declining toward each other.

3. A twin pedal assembly according to claim 2 wherein the angle of inclination of each beater shaft is in the range between approximately 5 and 45 degrees to the horizontal.

4. A twin pedal assembly according to claim 2 wherein the angle of inclination of each beater shaft is approximately 20 degrees to the horizontal.

5. A twin pedal assembly according to claim 2 wherein the support posts are disposed and the beater shafts are inclined in predetermined relationship with one another, such that the points of contact between the beaters at the drum skin are less than approximately 12 centimeters apart, thereby swing that both beaters are able to hit a relatively narrow strike zone simultaneously.

6. A twin pedal assembly according to claim 2 wherein the support posts are disposed and the beater shafts are inclined in predetermined relationship with one another, such that the points of contact between the beaters at the drum skin are no more than approximately 6 centimeters apart, thereby ensuring that both beaters are able to hit a relatively narrow strike zone simultaneously.

7. A twin pedal assembly according to claim 1 wherein the drive mechanism includes a drive plate associated with each foot plate, a drive cam connected to each beater shaft, and a drive linkage extending between each drive plate and the corresponding drive cam.

8. A twin pedal assembly according to claim 7 wherein the drive linkage is flexible and selected from the group comprising a chain, flexible cord, strap, cable, line or other suitable form of pliable linkage.

9. A twin pedal assembly according to claim 7 wherein the drive linkage takes the form of a chain.

10. A twin pedal assembly according to claim 7 wherein the drive linkage includes one or more rigid linkages with suitable flexible connections or universal joints.

11. A twin pedal assembly according to claim 7 including resilient bias means so as to bias the beaters resiliently toward a rest position in which the stems are disposed in a generally horizontal orientation and the heads are positioned away from the drum.

12. A twin pedal assembly according to claim 7 including a idler plate connected with each beater shaft, and a spring extending effectively between the base and the idler, so as to bias the beaters resiliently toward a rest position in which the stems are disposed in a generally horizontal orientation and the heads are positioned away from the drum.

13. A twin pedal assembly according to claim 7 wherein the drive cams are configured such that for a constant rate of travel of the foot pedals, maximum torque and hence acceleration are transferred to the beaters during the initial phase of movement away from the rest position, and maximum rotational speed and hence momentum are imparted during the final phase of movement of the beaters toward the strike zone.

14. A twin pedal assembly according to claim 7 wherein, each beater is mounted to the corresponding beater shaft by means of an offset bracket, such that each stem and the associated drive cam are radially displaced from the rotational axis of the beater shaft.

15. A twin pedal assembly according to claim 14 wherein the offset bracket is disposed such that with the beater stem in the generally vertical orientation and the beater head contacting the strike zone, the stem and the drive cam are displaced forwardly of the beater shaft, closely adjacent the drum skin.

16. A twin pedal assembly according to claim 7 wherein, each beater and the associated drive cam are mounted on the outer end of, and on the same side of, the respective beater shaft so as to maintain substantially direct and approximately coplanar of transmission of drive between each foot pedal drive plate and the associated beater.

17. A twin pedal assembly according to claim 7 wherein, adjustment mechanisms are provided between each foot pedal and the associated drive plate.

18. A twin pedal assembly according to claim 7 wherein, adjustment mechanisms are provided between each drive plate and the associated drive cam.

19. A twin pedal assembly according to claim 7 wherein, adjustment mechanisms are provided between each drive cam and the associated beater shaft.

20. A twin pedal assembly according to claim 12 wherein, adjustment mechanisms are provided between each spring and the associated idler plate.

21. A twin pedal assembly according to claim 12 wherein, adjustment mechanisms are provided between each idler plate and the associated beater shaft.

22. A twin pedal assembly according to claim 14 wherein, adjustment mechanisms are provided between each offset bracket and the associated beater shaft.

23. A twin pedal assembly according to claim 1 wherein, adjustment mechanisms are provided between each stem and the associated offset bracket.

24. A twin pedal assembly according to claim 1 wherein, the base is formed in two halves to facilitate compact storage and transportation.

25. A twin pedal assembly according to claim 1 wherein, the base may be formed as a single structure, or from more than two components in an assembly.

26. A twin pedal assembly according to claim 1 wherein the beater shafts are mounted on journal bearings.

27. A twin pedal assembly according to claim 1 wherein the foot pedals are pivotally mounted to the base for rotation about respective vertically inclined axes.

28. A twin pedal assembly according to claim 27 wherein each beater shaft axis is substantially parallel to a corresponding foot pedal axis such that each beater and the foot pedal move in substantially parallel planes thereby minimizing energy losses.

29. A twin pedal assembly according to claim 28 wherein the planes are closely spaced or substantially coplanar.

30. A twin pedal assembly according to claim 1 wherein the foot pedals are inclined inwardly to reflect the natural ergonomics of the user's feet.

* * * * *

UNITED STATES PATENT AND TRADEMARK OFFICE

CERTIFICATE OF CORRECTION

PATENT NO. : 6,734,350 B2
DATED : May 11, 2004
INVENTOR(S) : Sleishman

It is certified that error appears in the above-identified patent and that said Letters Patent is hereby corrected as shown below:

Column 7,
Line 4, replace “swing” with -- ensuring --

Column 8,
Line 1, replace “claim 1” with -- claim 14 --

Signed and Sealed this

Twenty-first Day of December, 2004

JON W. DUDAS
*Director of the United States Patent and Trademark Office*